United States Patent [19]

De Rycke et al.

[11] Patent Number: 5,009,984

[45] Date of Patent: Apr. 23, 1991

[54] METHOD FOR PROCESSING A PHOTOGRAPHIC SILVER HALIDE EMULSION MATERIAL

[75] Inventors: Gino L. De Rycke, Mortsel; Antonius A. Rutges, Boechout; Jozef P. De Prijcker, Hamme, all of Belgium

[73] Assignee: Agfa-Gevaert, N.V., Mortsel, Belgium

[21] Appl. No.: 372,856

[22] Filed: Jun. 29, 1989

[30] Foreign Application Priority Data

Aug. 9, 1988 [BE] Belgium ..... 88201706.4

[51] Int. Cl.[5] ..... G03C 5/26; G03C 5/38

[52] U.S. Cl. ..... 430/404; 430/206; 430/233; 430/247; 430/248; 430/249; 430/965

[58] Field of Search ..... 430/206, 404, 233, 248, 430/428, 429, 965, 564, 455, 247

[56] References Cited

U.S. PATENT DOCUMENTS

| | | | |
|---|---|---|---|
| 3,179,517 | 4/1965 | Tregillus et al. | 430/206 |
| 3,236,642 | 2/1966 | Rintelen et al. | 430/233 |
| 3,647,464 | 3/1972 | Smith et al. | 430/206 |
| 3,689,272 | 9/1972 | Schwan et al. | 430/206 |
| 4,605,609 | 8/1986 | Okazaki et al. | 430/233 |
| 4,760,015 | 7/1988 | Berthold et al. | 430/429 |
| 4,775,614 | 10/1988 | De Rycke | 430/206 |
| 4,830,949 | 5/1989 | De Rycke | 430/206 |

*Primary Examiner*—Richard L. Schilling
*Attorney, Agent, or Firm*—William J. Daniel

[57] ABSTRACT

A method for processing an imagewise exposed photographic silver halide emulsion material using a receptor element for complexed silver halide which element contains a stabilizing agent corresponding to one of the following general formulae (I) or (II), tautomeric structures or a precursor form thereof:

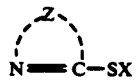

(I)

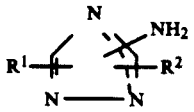

(II)

wherein:

X represents hydrogen, alkali metal, ammonium or organic amine,

Z represents the non-metallic atoms necessary to form a 5- or 6-membered heterocyclic nucleus, and each of $R^1$ and $R^2$ (same or different) represents hydrogen, amino, alkyl, alkenyl, cycloalkyl, aryl, alkoxy, alkylthio, alkylsulfonyl, sulfamoyl, acyl, —SH or a heterocyclic group.

11 Claims, No Drawings

METHOD FOR PROCESSING A PHOTOGRAPHIC SILVER HALIDE EMULSION MATERIAL

FIELD OF INVENTION

The present invention relates to a method for rapid and ecologically clean processing of an exposed photographic silver halide emulsion element yielding silver images of archival quality.

BACKGROUND OF THE INVENTION

Silver halide emulsion materials with all their enormous advantages in sensitivity, spectral sensitization and capability of producing black-and-white and color images with strong optical density and high resolving power have the drawback of requiring in conventional processing several processing liquids and a time consuming drying for the final image. Particularly the fixing and rinsing steps are of relatively long duration when archival image quality is desired. Moreover, exhausted fixing liquids and even wash liquids containing dissolved silver pose an ecological problem because draining of silver ions into the sewer is permitted only in a very limited quantity. Further, silver recovery from fixing liquids in large scale processing is nowadays a must for its economic importance and proceeds by the deposition of dissolved silver as metal or silver precipitate from the fixing liquid bulk.

Under the impulse of these specific drawbacks and requirements associated with the conventional processing of photographic silver halide emulsion materials there has been a constant search for a rapid ecologically clean processing which is as dry as possible and offers archival high quality images.

In a successful rapid access processing known as diffusion transfer reversal (DTR-) processing [ref. Photography—Its Materials and Processes—by C. B. Neblette—6th ed. D. Van Nostrand Company—New York (1962), p. 3721] an exposed silver halide emulsion material is developed in the presence of a silver halide solvent. Hereby the non-developed silver halide is complexed and transferred by diffusion into an image-receiving material to form therein a silver image by reduction with the aid of a developing agent in the presence of minute amounts of so-called development nuclei, e.g. colloidal silver or heavy metal sulphides.

Many efforts and much research were devoted to obtain diffusion transfer images of high quality in the image receiving material with reduced amount of silver halide in the light-sensitive material as compared with the conventional processing. These efforts and research directed to a large choice of development nuclei, black-toning agents, binding agents, etc. . . . , led for many purposes to satisfactory image quality in the image receiving material. However, in some fields of photography, e.g. the graphic arts and micrography, where in some applications particular sharpness, high resolving power or other extreme sensitometric qualities are required the formation of the final image in the photosensitive material by conventional processing, i.e. image formation not based on diffusion transfer of image forming substances. is still preferred.

In U.S. Pat. No. 3,179,517 and published European Patent Application 0 221 599 processes for developing and fixing a photographic silver halide emulsion material with a minimum of processing liquid in combination with a processing or receptor web comprising a silver complexing agent and silver ion precipitating agent, e.g. zinc sulphide for use in a conversion reaction forming a silver sulphide precipitate, are described.

The above described processes operating with fairly small amounts of liquids and a processing element containing the necessary chemicals for fixing an image-wise exposed silver halide emulsion material have the advantage to make a washing or rinsing step not absolutely necessary.

However, if a washing or rinsing step is omitted under conditions of fairly high relative humidity, e.g. 80 % relative humidity, and elevated temperature, e.g. 35 ° C., silver images obtained from a developed silver halide emulsion, particularly those silver halide emulsions containing some silver bromide, undergo a degradation in that viewed under diffuse light conditions light straying spots appear as black spots in the silver image parts having a relatively low optical density (i.e. in the silver image parts having an optical density in the range of 0.05 to 0.5). Said light straying spots are particularly disturbing in micrograph enlargement by severely degrading the image quality of the obtained enlarged images. It has been experimentally established by us that the light straying spots correspond with rather coarse silver halide crystal grains formed by re-halogenation, in particular re-bromination, of silver metal particles obtained in the development.

OBJECTS OF THE INVENTION

It-is an object of the present invention to provide an ecologically clean rapid access processing method for exposed photographic silver halide emulsion layer materials wherein the obtained silver images when not subjected to rinsing are not degraded under conditions of elevated temperature and fairly high relative humidity.

It is a further object of the present invention to provide a stable receptor element for use in rapid ecologically clean processing providing silver images free from the described degradation.

Other objects and advantages of the present invention will appear from the further description.

SUMMARY OF THE INVENTION

According to the present invention there is provided a method for processing an imagewise exposed photographic silver halide emulsion material which method comprises the steps of:

(A) developing an image-wise exposed silver halide emulsion layer by means of at least one diffusible developing agent in the absence of a silver halide solvent at least in such an amount that would reduce the coverage of developed silver metal (Ag/m2) by more than 20%, the development taking place with an aqueous alkaline liquid having preferably a pH of at least 9, more preferably of at least 11.

(B) bringing the thus developed photographic material while still wet with the liquid from step (A) with its silver halide layer side in intimate contact with a water-absorbing layer of a receptor element that contains in an organic hydrophilic colloid binder a silver halide complexing agent, or silver halide solvent, and in dispersed colloidal form a metal sulphide capable of converting complexed silver halide into silver sulphide, (C) maintaining said photographic material and receptor element in contact to effect the transfer of dissolved complexed silver compound into said receptor element until the undeveloped silver halide remaining in the exposed silver halide emulsion layer is substantially completely removed, and (D) separating the photographic material from the receptor element, wherein said water-absorbing layer of said receptor element contains (i) said silver complexing agent at a coverage per m2 corresponding with at least 5 mole % of the molar coverage per m2 of silver halide in the unexposed photographic material, (ii) said metal sulphide at a sulphide ion coverage per m2 at least stoichiometrically equivalent with the silver ion coverage present in the photographic material in unexposed and undeveloped state, and (iii) a diffusible silver image stabilizing agent at a coverage of at least 0.01 g/m2, said stabilizing agent corresponding to one of the following general formulae (I) or (II) or a tautomeric structure or precursor form thereof:

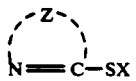

(I)

(II)

wherein:

X represents hydrogen, alkali metal, ammonium or organic amine, Z represents the non-metallic atoms necessary to complete a 5- or 6-membered heterocyclic nucleus, and each of 1 and R2 (same or different) represents hydrogen, amino, alkyl, alkenyl, cycloalkyl, aryl, alkoxy, alkylthio, alkylsulfonyl, sulfamoyl, acyl, —SH or a heterocyclic group.

The present invention includes the use of said stabilizing agents in masked or form, e.g. in a form wherefrom said agents are set free by alkaline aqueous treatment as described e.g. in U.S. Pat. No. 4,307,175 and prior art mentioned therein.

DETAILED DESCRIPTION OF THE INVENTION

In a preferred embodiment according to the present invention the silver stabilizing agent is a cyclic thiourea compound corresponding to the following general formula (III) or a corresponding tautomeric structure thereof:

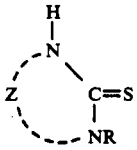

(III)

wherein:

R represents hydrogen or a hydrocarbon group, e.g. an alkyl, alkenyl, aryl or aralkyl group including said groups in substituted form, and Z represents a bivalent saturated hydrocarbon group including said group in substituted form to complete a 5- or 6-membered heterocyclic ring The preparation of these cyclic thiourea compounds and their use in a stabilization-fixing treatment is described in published European Patent application 0 189 604.

The following Table 1 contains a list of preferred compounds within the scope of the above general formula (III) with a literature reference for their preparation.

TABLE 1

| Compound No. | R | Z | Reference |
|---|---|---|---|
| 1 | H | $-CH_2-CH_2-$ | US-P 3,801,330 |
| 2 | H | $-CH(CH_3)-CH_2-CH_2-$ | " |
| 3 | $-CH_2-CH_2-OH$ | $-CH_2-CH_2-$ | " |
| 4 | $-CH_2-CH=CH_2$ | $-CH_2-CH_2-$ | " |
| 5 | $-C_6H_5$ | $-CH_2-CH_2-$ | " |
| 6 | H | $-CH_2-CH_2-CH_2-$ | " |
| 7 | H | $-CH_2-CHOH-CH_2-$ | GB-P 931,560 |
| 8 | H | $-CH_2-CH_2-C(CH_3)(OH)-$ | DE-AS 1,065,849 |
| 9 | H | $-CH(C_6H_5)-CH_2-C(CH_3)(OH)-$ | " |

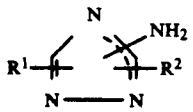

wherein:

X represents hydrogen, alkali metal, ammonium or organic amine, Z represents the non-metallic atoms necessary to complete a 5- or 6-membered heterocyclic nucleus, and each of 1 and R2 (same or different) represents hydrogen, amino, alkyl, alkenyl, cycloalkyl, aryl, alkoxy, alkylthio, alkylsulfonyl, sulfamoyl, acyl, —SH or a heterocyclic group.

The present invention includes the use of said stabilizing agents in masked or form, e.g. in a form wherefrom said agents are set free by alkaline aqueous treatment as described e.g. in U.S. Pat. No. 4,307,175 and prior art mentioned therein.

DETAILED DESCRIPTION OF THE INVENTION

In a preferred embodiment according to the present invention the silver stabilizing agent is a cyclic thiourea compound corresponding to the following general formula (III) or a corresponding tautomeric structure thereof:

The preparation of amino-1,2,4-triazole compounds according to general formula (II) is described in the book "The Chemistry of Heterocyclic Compounds", vol. 37 (1981) - John Wiley & Sons, New York. The use of said amino-1,2,4-triazole compounds in an aqueous after treatment bath as stabilizing substances for silver images is described in German Offenlegungsschrift (DE-OS) 3 613 622.

In particularly practical embodiments the said receptor element is used in the form of a web.

In the preparation of the processing web the specified heterocyclic compounds are simply dissolved in the aqueous coating composition wherefrom the water-permeable receptor layer is applied on a support in web form.

For avoiding loss of developable silver halide in the still developing silver halide emulsion material step (A) preferably is carried out in the complete absence of silver halide solvent.

The metal sulphide for chemically converting with the complexed silver halide is into silver sulphide is preferably a colloidal heavy metal sulphide wherein the metal has an atomic number at least 24. Examples of such metals are: chromium, nickel, cobalt, copper, tin, lead, cadmium, antimony and zinc. Preference is given to the use of zinc sulphide.

By colloidal heavy metal sulphide is understood a heavy metal sulphide with an average particle size not larger than 0.1 μm not excluding however, agglomerates thereof.

The heavy metal sulphide coverage per m2 is preferably at least 20% in excess over the stoichiometric amount corresponding with the silver halide coverage per m2 in the undeveloped silver halide emulsion layer. A receptor element according to the present invention for the fixing of developed photographic silver halide emulsion materials comprises on a flexible support a water-absorbing layer that contains in an organic hydrophilic colloid binder (i) a silver halide complexing agent, or silver halide solvent, (ii) in dispersed colloidal form a metal sulphide capable of forming silver sulphide by conversion reaction with complexed silver halide, and (iii) a diffusible silver image stabilizing agent at a coverage of at least 0.01 g/m2, preferably in the range of 0.01 to 0.50 g/m2, said stabilizing agent corresponding to one of the following general formulae (I) or (II) or a tautomeric structure thereof:

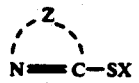
(I)

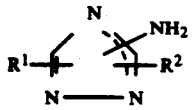
(II)

wherein:

X represents hydrogen, alkali metal, ammonium or organic amine,

Z represents the non-metallic atoms necessary to complete a 5- or 6-membered heterocyclic nucleus, and $R^1$ and $R^2$ (same or different) represent hydrogen, amino, alkyl, alkenyl, cycloalkyl, aryl, alkoxy, alkylthio, alkylsulfonyl, sulfamoyl, acyl, —SH or a heterocyclic group.

Fog formation by deposition of colloidal silver and optionally colloidal silver sulphide in the photographic material is substantially avoided by contacting the still wet developed photographic material with an initially dry receptor element.

Normally a quantity of alkaline aqueous processing liquid in the range of 20 to 60 ml per m2 are soaked up in the photographic material during development.

The water-absorbing layer(s) of the receptor element act as a kind of sponge and make it possible to obtain very rapidly almost dry photographic copies after completing the transfer of the undeveloped complexed silver halide into said receptor element.

Any known silver halide solvent may be used in the process of the present invention but best results are obtained with a watersoluble thiosulphate such as sodium thiosulphate and ammonium thiosulphate. The coverage of such thiosulphate in the receptor element is preferably in the range of 0.50 to 5 g per m2.

These relatively small amounts of silver halide solvent are sufficient since the latter is regenerated in the precipitation of the complexed silver as silver sulfide and will be used in complexing again and again till complete extraction of the silver halide from the silver halide emulsion layer is achieved.

Suitable hydrophilic organic colloids for use as binding agent in a water-absorbing layer of the processing element according to the present invention are of the type known from photographic silver halide emulsion materials. Examples of useful hydrophilic colloid binding agents are: gelatin, polyvinyl alcohol, polyvinyl pyrrolidinone, polyacrylamide, methyl cellulose and carboxymethyl cellulose that may form coating solutions with fairly high viscosity.

Other ingredients that may be present in a water-absorbing layer of the receptor element, e.g. for reducing stickiness, are polymers applied from an aqueous polymer dispersion, i.e. latex. For that purpose polymethyl methacrylate latex is particularly useful.

The thickness of a water-absorbing layer or packet of water-absorbing layers is e.g. from 5 to 35 μm preferably in the range of 10 to 30 μm. The organic hydrophilic colloid binder is preferably present in the range of 4 to 10 g per m2.

In a receptor sheet or web of the present invention the water-absorbing layer containing one of the above defined silver image stabilizing agents is applied on a support that is preferably flexible. Particularly suitable supports are paper supports and resin supports of the type known in photographic silver halide emulsion materials.

The liquid used for carrying out the development of the photographic material may be applied in any way known to those skilled in the art, e.g. by dipping or spraying.

According to a preferred embodiment the liquid used in the development is applied to the photographic material by meniscus coating in a tray device provided with conveying rollers whereby it is possible to apply only a very small amount of liquid, e.g. in the range of 20 to 60 ml per m2, that is consumed almost completely so that at most only a minor amount of processing liquid is returned into the liquid container so that development takes place always with fresh processing liquid and no waste liquid is left or formed.

Due to the presence of swellable hydrophilic colloidal substances, the receptor sheet or web possesses sufficient liquid absorption power to act as a sponge to ensure that the photographic material after its separation is left substantially dry, certainly when the contacting proceeds at elevated temperature. The omission or shortening of a drying step is a real advantage with the benefit of rapid access to the image and is energy saving.

According to a particular embodiment applied in instant photography the developing liquid is made available in a liquid container, i.e. a so-called "pod", associated with the photographic silver halide emulsion material (see Neblette's Handbook of Photography and Reprography, 7th ed. Edited by John M. Sturge (1977) p. 282–285).

Other techniques for providing processing liquid in situ in a photographic silver halide emulsion material operate with micro-capsules that are pressure and/or heat-sensitive. Examples of such micro-capsules, their preparation and use are described in GB-P 1,034,437 and 1,298,194. In another technique applicable for almost dry processing use is made of photographic materials incorporating the photographic processing substances in so-called thermosolvents that are substances solid at room temperature but exhibit wetting capacity on melting by heating the photographic material. Examples of thermosolvents (also called "heat-solvents" and) their use in photographic materials are described e.g. in U.S. Pat. No. 3,438,776, published European Patent Application 0 120 306 and published DE-A 3 215 485. In the latter Patent Applications dye diffusion transfer materials incorporating developing agents and thermosensitive base releasing compounds are described that after image-wise exposure are heated, e.g. up to 110 ° C., to release a free base and are processed with plain water, optionally at elevated temperature.

The fixing of the undeveloped silver halide is carried out preferably in the temperature range of 15° C. to 60° C. but may be speeded up by increase of the temperature, so that steps (B) and (C) of the present process are carried out e.g. in the temperature range of 15° C. to 110° C.

A particularly rapid transfer of the silver complex compounds and silver precipitation in the receptor web or sheet proceeds at elevated temperature in the range of 30 to 110° C. The heating can be carried out by bringing the photographic material contacting the receptor sheet or web between heated plates or rollers or by irradiation with infra-red light or any other heating technique applied in the photographic processing art.

It has been found experimentally that the treatment of the developed photographic material with an acid stop bath or neutral rinsing liquid has the affect of retarding access to the final image not only because such treatment takes time but also because the lowering of the pH in the photographic material and receptor element slows down the speed of fixing and silver precipitation.

By using the above defined image stabilizing agents in the process according to the present invention a final washing or rinsing of the silver halide emulsion material after its contact with the present receptor element, e.g. sheet or web, need not to be included for obtaining silver images with archival quality.

The present process offers a particularly rapid access to the fixed photographic print when the photographic material in its exposed state contains already the necessary developing agent(s) and the processing is carried out with an aqueous alkaline liquid, called activator liquid, having preferably a pH of at least 9, more preferably of at least 11.

In a particular embodiment the silver halide emulsion materials contain the necessary developing agent(s) in combination with a base generating or base releasing agent, hereby the alkalinity of the aqueous liquid used in step (A) can be obtained in situ from substances incorporated in the photographic material itself.

According to one embodiment a base generating system is used wherein a photographic silver halide emulsion material contains as described e.g. in U.S. Pat. No. 3,260,598 and in published European Patent Application 0 210 659 a slightly soluble metal compound such as zinc oxide and in an aqueous processing liquid a substance that by reaction with said compound yields hydroxyl ions. Such a substance is e.g. sodium picolinate acting as complexing agent for zinc ions. Using such base generating system the aqueous processing liquid on contact with said photographic material becomes alkaline in situ in step (A).

According to another embodiment a thermally activated base generating compound is used in the photographic material which after its image-wise exposure is heated for releasing a free base so that the liquid treatment of the photographic material in step (A) initially starts with plain water to effect development in the presence of a base released in the photographic material. Typical base-releasing agents for use in photographic silver halide emulsion materials are described in GB-P 998,949 and in DE-OS 3,529,934.

The process of the present invention is applied preferably in conjunction with silver halide emulsion materials containing silver bromide and is particularly advantageous in combination with silver halide emulsion materials the silver halide of which is mainly (at least 50 mole %) silver bromide.

A survey of the preparation of silver halide emulsions, their chemical and spectral sensitization and stabilization against fog is given e.g. in Research Disclosure December 1978, item 17643 titled "Photographic silver halide emulsions, preparations, addenda, processing and systems".

Photographic materials in the form of a sheet may be fixed in contact with receptor materials in sheet form, e.g. by conveying them in contact between pressure rollers as are present in classical diffusion transfer reversal apparatus some types of which are described in "Photographic Silver Halide Diffusion Processes" by André Rott and Edith Weyde, Focal Press—London—New York (1972) p. 242–256.

Photographic materials are advantageously processed likewise by contacting with a receptor web delivered by a spool. When the photographic material itself is in the form of a web or ribbon the fixing web and photographic material are each supplied preferably from different spools between two parallel plates exerting some pressure to the contacting materials. By polishing the plates or coating them with polytetrafluoroethylene their friction is kept low so that a smooth passage of the contacting materials between the plates takes place. In connection herewith attention is drawn to an apparatus suitable for web processing of pre-wetted photographic material and DTR-receptor material described in the already mentioned Neblette's Handbook of Photography and Reprography, p. 253–254 under the trade name DITRICON of HRB-Singer.

According to a preferred embodiment a receptor web applied in carrying out the present invention is supplied from a spool in dry state and brought together with a still wet developed photographic material on another spool for the accomplishment of the transfer of the dissolved silver halide and scavenging of its silver ions in the web. Thereupon the web is peeled apart from the film and web and film are wound on separate spools. The film is optionally rinsed and dried before storage. An arrangement for rapid film or web processing is illustrated in the already mentioned book of André Rott and Edith Weyde, p. 156.

To obtain a very rapid moistening the surface of the receptor web or sheet may be coated or contain a wetting agent. Examples of particularly useful wetting agents are fluoroalkyl wetting agents, e.g. of the type described in Belgian Patent Specification 742,680 and the anionic wetting agents described in EP 0 014 008.

According to a special embodiment the present processing web or sheet is adapted for the production of a "retained image" by a dye diffusion transfer process. For improving the dye transfer the present processing sheet or web contains also a mordanting agent for fixing the transferred dye.

Several embodiments of the dye diffusion transfer process are described by Christian C. Van de Sande in Angew. Chem. Int. Ed. Engl. 22 (1983) 191–209. The terminology "retained image" is used e.g. in Research Disclosure (No. 17362) of December 1978 and relates to a dye diffusion transfer process wherein the image left (retained) in the photographic dye diffusion transfer material after image-wise removal of mobile or mobilized dye is used as the final photographic product containing a silver image and dye image(s) in superposition. This technique gives a considerable economy in silver consumption since optical density is built up both by dye and silver metal.

When anionic dyes have to be mordanted the water-absorbing layer used in the present receiving sheet or web contains cationic polymeric mordants as described e.g. in U.S. Pat. No. 4,186,014, wherein a particularly useful mordanting agent prepared from 4,4 -diphenylmethane diisocyanate and N-ethyldiethanolamine quaternized with epichlorohydrine is described. Other useful mordanting agents are described in U.S. Pat. No. 2,882,156, 2,484,430, 3,271,147 and 4,186,014.

A mordant having particularly good fixing power for anionic dyes is called mordant A and has the following structure (the percentage values are mole %):

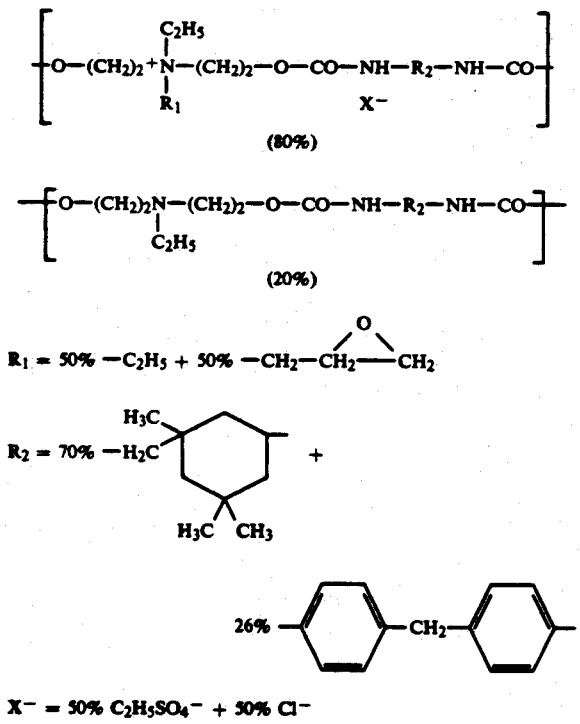

$X^- = 50\%\ C_2H_5SO_4^- + 50\%\ Cl^-$

Said mordant is prepared analogously to Example 12 of U.S. Pat. No. 4,186,014 and is called hereinafter Mordant A.

The coverage of the mordant is e.g. in the range of 0.1 to 5.0 g per m2. A mordant such as Mordant A having itself binding properties may play the role of hydrophilic colloid binding agent in the processing sheet or web according to the present invention.

According to a particular embodiment in the processing element a mordanting agent is used to remove from the photographic material not only an ionic dye as is the case in retained dye image production by a dye diffusion transfer process but likewise any other residual ionic chemical, e.g. ionic residual oxidized or unoxidized developing agent, e.g. hydroquinone monosulphonate, spectral sensitizing dyes and/or filtering dyes and/or anti-halation dyes to obtain a more white or cleaner image background. Such may be of interest in the processing of double side coated radiographic materials that contain such dyes for lowering the cross-over as described e.g. in U.S. Pat. No. 4,130,428.

EXAMPLES OF THE INVENTION

The following examples illustrate the present invention without, however, limiting it thereto. All ratios, percentages and parts are by weight unless otherwise stated.

EXAMPLE 1 (comparative example)

Preparation of colloidal zinc sulphide

In a 5 l beaker were put 300 g of $Na_2S.9\ H_2O$ in 1000 ml of distilled water. While vigorously stirring a solution of 400 g of $ZnSO_4.7\ H_2O$ in 1000 ml of distilled water were added to the sodium sulphide solution. After the addition stirring was continued for 10 min at room temperature (20° C.).

The formed colloidal precipitate was separated by filtering on a paper filter and washed on that filter with 1 l of distilled water. Thereupon washing was completed by mixing the precipitate with 2l of distilled water and filtering again. The colloidal ZnS having an average grain size of 5 nm was kept in the form of a dispersion (slurry) containing 14 g of ZnS per 100 g. Yield of colloidal ZnS: 120 g.

The colloidal zinc sulphide was introduced into an aqueous gelatin solution to obtain a colloidal dispersion containing 5 % of zinc sulphide and 5.4 % of gelatin.

Preparation of receptor sheet

A coating composition was made by thoroughly mixing the following ingredients:

| | |
|---|---|
| colloidal zinc sulphide dispersion | 80 g |
| ammonium thiosulphate | 0.50 g |
| compound 6 of Table 1 | 0.05 g |
| demineralized water | 9 ml |
| Mordant A | 10 g |
| 1.4% aqueous solution of 7-ethyl-2-methyl-4-undecanol-H sulphate sodium salt as wetting agent | 1 ml |

The coating composition was applied on a subbed polyethylene terephthalate support at a wet coating thickness of 135 μm.

The dried receptor layer contained per m2:

| The dried receptor layer contained per m2 | |
|---|---|
| colloidal zinc sulphide | 5.50 g |
| ammonium thiosulphate | 0.70 g |
| compound 6 of Table 1 | 0.07 g |
| Mordant A | 1.40 g |
| gelatin | 4.30 g |

Fixing processing

A microfilm material was provided containing a gelatin-silver halide emulsion layer incorporating silver bromide-chloride grains (AgBr: 99 mole % and AgCl: 1 mole %) having an average grain size of 0.30 μm. The silver halide emulsion layer was applied at a coverage of silver halide equivalent with 2.7 g of silver nitrate per m2 and the gelatin to silver halide ratio was 1 (the silver halide being expressed as an equivalent amount of silver nitrate). The silver halide emulsion layer contained as developing agent hydroquinone at a coverage of 0.20 g per m2.

A strip of said microfilm material in half of its surface area was exposed through a step wedge and treated at 40° C. for 5 s with an alkaline activator solution as described hereinafter.

While being still wet by the activator solution the microfilm material was contacted for 1 minute at 20° C. with the receptor material prepared as described above. After separation an amount of silver equivalent with 0.01 g of silver nitrate per m2 was left in the unexposed half of the microfilm material.

| Alkaline activator solution | |
|---|---|
| NaOH | 30 g |
| $Na_2SO_3$ | 50 g |
| NaBr | 2 g |
| ethylene diamine tetra-acetic acid Na-salt | 1.5 g |
| hydroxyethylcellulose | 2.5 g |
| 1.4% aqueous solution of 7-ethyl-2-methyl-4-undecanol-H sulphate sodium salt as wetting agent | 1 ml |
| distilled water up to | 1000 ml |
| | pH:13.5 |

The processed photographic microfilm material was put for 2 days in an artificial climate chamber under conditions of 80 % relative humidity at 35° C. When inspected under diffuse light conditions as available in a microfilm enlarger (reader-printer with enlargement 550 times) the silver metal areas in the film did not show pronounced black spots in the low density (D=0.05 to 0.5) silver image parts of the enlargement. In the micrograph in said low density parts no spots having an average diameter larger than 0.1 μm were found, whereas by leaving out the stabilizing compound 6 from the receptor sheet used in the fixing processing a micrograph was obtained that under the above artificial climate treatment showed a large number of spots having an average diameter of 8 μm.

EXAMPLES 2 and 3

Example 1 was repeated with the difference that compound 6 of Table 1 was replaced respectively by the same molar amount of compound B and C having the following structure:

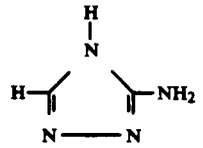

compound B

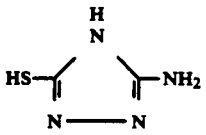

compound C

In the micrograph subjected to an artificial climate treatment as described in Example 1 and processed with the receptor sheet containing compound B black spots having an average diameter of only 1 μm were recognizable and in the micrograph obtained by processing with the receptor sheet containing compound C black spots with an average diameter of only 2 μm were found.

We claim:

1. A method of processing an imagewise exposed photographic silver halide emulsion material which method comprises the steps of:

(A) developing an image-wise exposed silver halide emulsion layer by means of at least one diffusible developing agent in at least the substantial absence of a silver halide complexing agent, the development taking place with an aqueous alkaline liquid, (B) bringing the thus developed photographic material while being still wet with the liquid from step (A) with its silver halide emulsion layer side in intimate contact with a water-absorbing layer of a receptor element that contains in an organic hydrophilic colloid binder a silver halide complexing agent and in dispersed colloidal form a metal sulphide capable of a conversion reaction with complexed silver halide to form silver sulphide, (C) maintaining said photographic material and receptor element in contact to allow the transfer of dissolved complexed silver compound into said receptor element and conversion into silver sulphide until the undeveloped silver halide in the exposed silver halide emulsion layer is substantially completely so transferred and converted, and (D) separating the photographic material from the receptor element, wherein said water-absorbing layer of said receptor element contains (i) said silver complexing agent at a coverage per m2 of silver halide in the unexposed photographic material, (ii) said metal sulphide at a sulphide ion coverage per m2 at least stoichiometrically equivalent with the silver ion coverage present in the photographic material in unexposed and undeveloped state, and (iii) a diffusible silver image stabilizing agent at a coverage of at least 0.01 g/m2, said stabilizing agent is a cyclic thiourea compound corresponding to the following formula or a tautomeric form thereof:

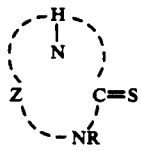

wherein:

R represent hydrogen or a hydrocarbon group including said group in substituted form, and Z represents a bivalent saturated hydrocarbon group including said group in substituted form to complete a 5- or 6-membered heterocyclic ring.

2. A method according to claim 1, wherein the receptor element is used in the form of a web.

3. A method according to claim 1, wherein in the formula for said stabilizing agent corresponds to general formula (III) wherein R is hydrogen and Z is —$CH_2$—$CH_2$—$CH_2$—.

4. A method according to claim 1, wherein said stabilizing agent is used in the receptor element at a coverage in the range of 0.01 to 0.50 g/m2.

5. A method according to claim 1, wherein the metal sulphide is zinc sulphide.

6. A method according to claim 1, wherein the photographic silver halide emulsion material contains sliver bromide.

7. A method according to claim 1, wherein the silver halide is at least 50 mole % silver bromide.

8. A method according to claim 1, wherein said process is free of does not a final washing or rinsing of the silver halide emulsion material after its contact with said receptor element.

9. A method according to claim 1, wherein said receptor element contains also a mordanting agent for fixing dyes.

10. A method according to claim 1, wherein said receptor element contains a wetting agent.

11. A method according to claim 1, wherein the aqueous alkaline liquid used in the development is applied to the photographic material by meniscus coating.

* * * * *